US006264833B1

(12) United States Patent
Reamsnyder et al.

(10) Patent No.: US 6,264,833 B1
(45) Date of Patent: Jul. 24, 2001

(54) COOLANT FILTER ASSEMBLY FOR A VEHICLE

(75) Inventors: Christopher R. Reamsnyder, Elmore; Brian J. Langsdorf, Perrysburg; Allen B. Wright, Grand Rapids, all of OH (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/211,575

(22) Filed: Dec. 14, 1998

(51) Int. Cl.[7] ..... B01D 27/08; B01D 27/10

(52) U.S. Cl. ..... 210/133; 210/249; 210/434; 210/438; 210/440; 210/455; 210/DIG. 17; 285/133.11

(58) Field of Search ..... 210/133, 167, 210/206, 209, 420, 438, 440, 443, 444, 453, 455, 805, DIG. 17, 249, 434; 137/268; 422/282; 165/119; 285/133.4, 133.11, 133.21

(56) References Cited

U.S. PATENT DOCUMENTS

| | | | | |
|---|---|---|---|---|
| 3,682,308 | | 8/1972 | Moon . | |
| 3,726,262 | | 4/1973 | Moon . | |
| 3,776,384 | | 12/1973 | Offer . | |
| 3,859,216 | * | 1/1975 | Sisson et al. | 210/DIG. 17 |
| 4,075,098 | * | 2/1978 | Paul et al. | 210/209 |
| 4,142,973 | * | 3/1979 | Kachman | 210/133 |
| 4,782,891 | | 11/1988 | Cheadle et al. . | |
| 4,834,885 | * | 5/1989 | Misgen et al. | 210/440 |
| 4,992,166 | * | 2/1991 | Lowsky et al. | 210/DIG. 17 |
| 5,050,549 | | 9/1991 | Sturmon . | |
| 5,104,537 | * | 4/1992 | Stifelman et al. | 210/443 |
| 5,382,355 | * | 1/1995 | Arlozynski | 210/167 |
| 5,435,346 | | 7/1995 | Tregidgo et al. . | |
| 5,662,799 | * | 9/1997 | Hudgens et al. | 210/209 |
| 5,690,814 | | 11/1997 | Holt . | |
| 5,803,024 | | 9/1998 | Brown . | |

* cited by examiner

*Primary Examiner*—Matthew O. Savage

(57) ABSTRACT

A coolant filter kit, for attaching in-line to a coolant hose of a combustion engine, includes a fluid conduit member and a coolant filter apparatus. The fluid conduit member has a stem and two opposed branches connected to the stem, with an inlet formed in a first branch thereof, and an outlet formed in a second branch. The fluid conduit member further has a partition in the stem thereof, substantially separating a first flow chamber from a second flow chamber therewithin. In a preferred embodiment of the invention, a limited amount of fluid is allowed to flow directly from the inlet to the outlet without passing through the filter apparatus. The filter apparatus includes a hollow housing defining a filter chamber therein. A porous cylindrical filter element is disposed in the filter chamber of the housing. Optionally, the filter apparatus may include a slow-dissolving tablet or plug for releasing a supplemental coolant additive into coolant over time.

7 Claims, 6 Drawing Sheets

COOLANT FILTER ASSEMBLY FOR A VEHICLE

BACKGROUND OF THE INVENTION

1. Field of the Invention

The present invention relates to a coolant filter assembly kit for a vehicle, to a coolant filter assembly formed from the kit, and to a method of using same. More particularly, the present invention relates to a coolant filter assembly kit which includes both a fluid conduit member for placing in-line in a coolant line such as, e.g., a heater core circuit, and a coolant filter apparatus which is attachable to the fluid conduit member. The present invention also relates to a coolant filter assembly which is formed from components of the kit, and to a method of using the coolant filter assembly hereof to filter engine coolant.

2. Description of the Background Art

Some types of coolant filters are known, for filtering engine coolant during engine operation. Some of the known coolant filters include dissolving additive tablets or other mechanisms for the delayed release of supplemental chemical additives into the coolant. Examples of some known coolant filters can be found in U.S. Pat. Nos. 3,682,308, 3,726,262, 3,776,384, 4,782,891, 5,050,549, 5,435,346, 5,690,814, and 5,803,024.

Certain kits are also known and are commercially available to facilitate the process of draining coolant from a vehicle and subsequently refilling the vehicle with fresh coolant. These kits may include a hollow "T" shaped fitting for installing in-line in a vehicular heater hose. In this known type of T fitting, the base of the fitting is externally threaded to receive a female fitting of a standard garden hose thereon. To the best of applicant's understanding, this known type of T fitting is completely open on the inside thereof, so that any given leg of the "T" is in free fluid communication with both of the other legs.

With the increased emphasis on vehicle durability and longevity, a need still exists in the art for a kit which can be used to construct a coolant filter assembly, for adding in-line into a vehicle coolant line to provide a replaceable coolant filter, the kit including one such replaceable filter.

SUMMARY OF THE INVENTION

The present invention provides a coolant filter kit of components which can be assembled together to form a coolant filter assembly. The coolant filter assembly hereof is provided for attaching in-line to a coolant hose of a combustion engine, and for filtering engine coolant which passes therethrough.

A first component of the coolant filter kit hereof is a fluid conduit member, having a stem and two opposed branches connected to the stem.

The fluid conduit member has an inlet formed in a first branch thereof, and an outlet formed in a second branch. The fluid conduit member further has a first flow chamber formed therein in communication with the inlet, a second flow chamber formed therein in communication with the outlet, and a partition in the stem thereof, substantially separating the first flow chamber from the second flow chamber.

In a preferred embodiment of the invention, the partition does not completely block fluid flow from the first flow chamber to the second flow chamber, but instead, allows a limited amount of fluid flow therepast. The presence of the bypass feature, in conjunction with the presence of the partition between the first and second flow chambers of the fluid conduit member, provides two fluid pathways through the conduit member. A first of such pathways routes fluid flow through a filter apparatus for filtration thereof, and then back into the conduit member. A second of the pathways allows a limited amount of fluid to flow directly from the inlet to the outlet without passing through the filter apparatus, in order to provide an alternate flow mechanism in the event that the filter apparatus becomes plugged or severely restricted.

The coolant filter kit hereof also includes a removable and replaceable coolant filter apparatus, for attaching to the fluid conduit member to form a coolant filter assembly. The primary function of the filter apparatus is to filter contaminants out of liquid coolant flowing therethrough, once it is installed in a vehicle cooling system.

The filter apparatus includes a substantially cylindrical hollow housing defining a filter chamber therein. Preferably, the housing is formed from a housing body section which is a first cup-shaped member, and an end cap which a second cup-shaped member, and which is sealably attached to the body section to define a filter chamber therebetween. The housing has an end wall with a cylindrical bore formed therein, and the cylindrical bore is internally threaded to receive the stem of the fluid conduit member therein. A hollow cylindrical outlet tube is also provided in the filter chamber of the housing, coaxial to the cylindrical bore and attached to the housing end wall. The housing further has a series of inlet holes formed therein, arranged in an annular pattern surrounding the outlet tube.

The coolant filter apparatus also includes a filter member which is primarily made up of a porous cylindrical filter element, which is disposed in the filter chamber of the housing. The filter member has a hollow bore formed centrally therein, and is arranged in the filter chamber such that the hollow bore is in communication with the housing outlet tube. In a preferred embodiment of the invention, the filter member includes a first substantially disc-shaped end plate attached to the filter element at a first end thereof opposite the cylindrical bore, and a second plate attached to a second end of the filter element and having a central aperture formed therein. In this preferred embodiment, the filter element is oriented in the housing such that the central aperture of the second end plate surrounds, and is in fluid communication with, the housing outlet tube.

Also in the preferred embodiment of the invention, the coolant filter apparatus includes at least one spacer in the housing for spacing the filter member away from the housing inlet holes at the end of the cylindrical bore in the housing end wall section.

Optionally, the filter apparatus may include a slow dissolving tablet or plug for releasing a supplemental coolant additive into a coolant stream over time.

Accordingly, it is an object of the present invention to provide a method and apparatus for filtering engine coolant.

It is another object of the present invention to provide a removable and replaceable coolant filter apparatus for a vehicle.

It is a further object of the present invention to provide a coolant filter kit which is usable to retrofit an existing vehicle to add a coolant filter into a cooling system of the vehicle.

It is yet a further object of the present invention to provide a coolant filter assembly which may be incorporated into a new vehicle during the assembly process.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PRESENTLY PREFERRED EMBODIMENTS

Figure 1:
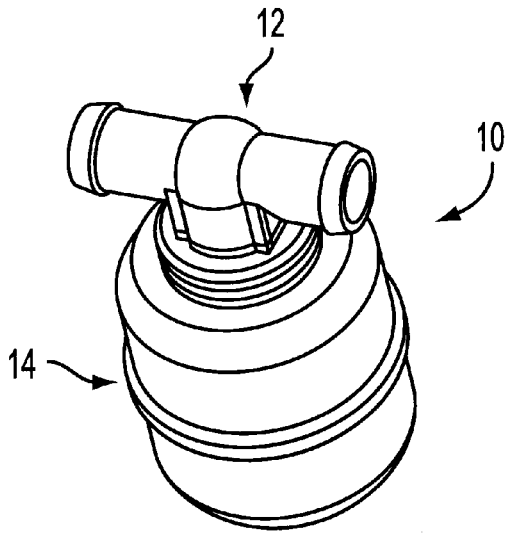
FIG. 1 is a perspective view of a coolant filter assembly in accordance with the present invention.
Figure 2:
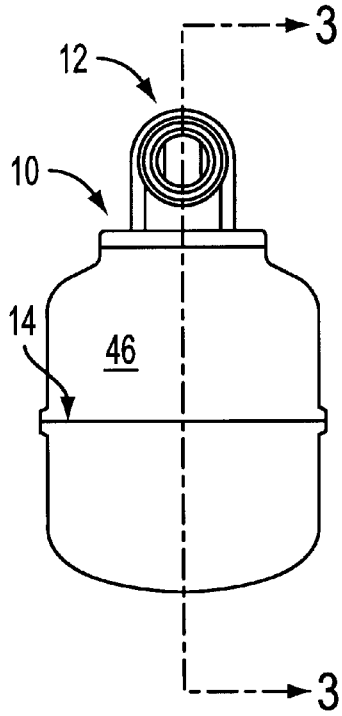
FIG. 2 is a side plan view of the assembly of FIG. 1.

Referring now to FIG. 1, a coolant filter assembly, for attaching in-line to a coolant hose of a combustion engine, is shown generally at 10. The assembly 10 may be easily constructed from assembling components of a kit 16 together. The components of the kit 16 according to the present invention are shown in the exploded view of FIG. 3. The assembly 10, and the kit 16 from which it is made, each include two primary components, which are firstly, a fluid conduit member 12, and secondly, a removable and replaceable coolant filter apparatus 14 which is threadably attachable to the fluid conduit member 12. Each of these components will be discussed in further detail hereinbelow. The present invention encompasses the coolant filter kit 16, the individual components of the kit, the assembly 10 which may be formed from the kit, and the method of using the assembly to filter coolant.

THE FLUID CONDUIT MEMBER

Figure 3:
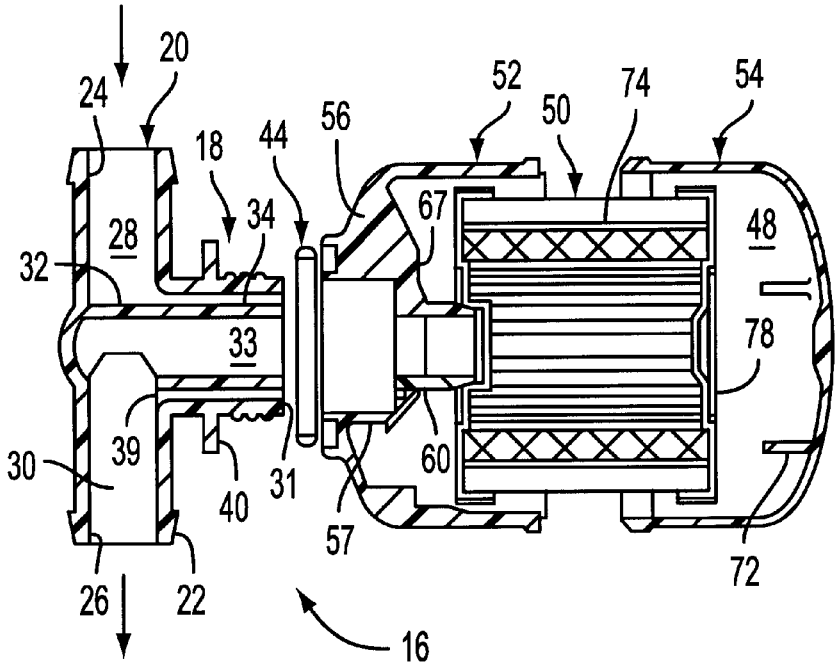
FIG. 3 is an exploded cross-sectional view of the assembly of FIGS. 1–2, taken along the line 3—3 of FIG. 2, and showing the components of a coolant filter assembly kit according to the invention.
Figure 4:
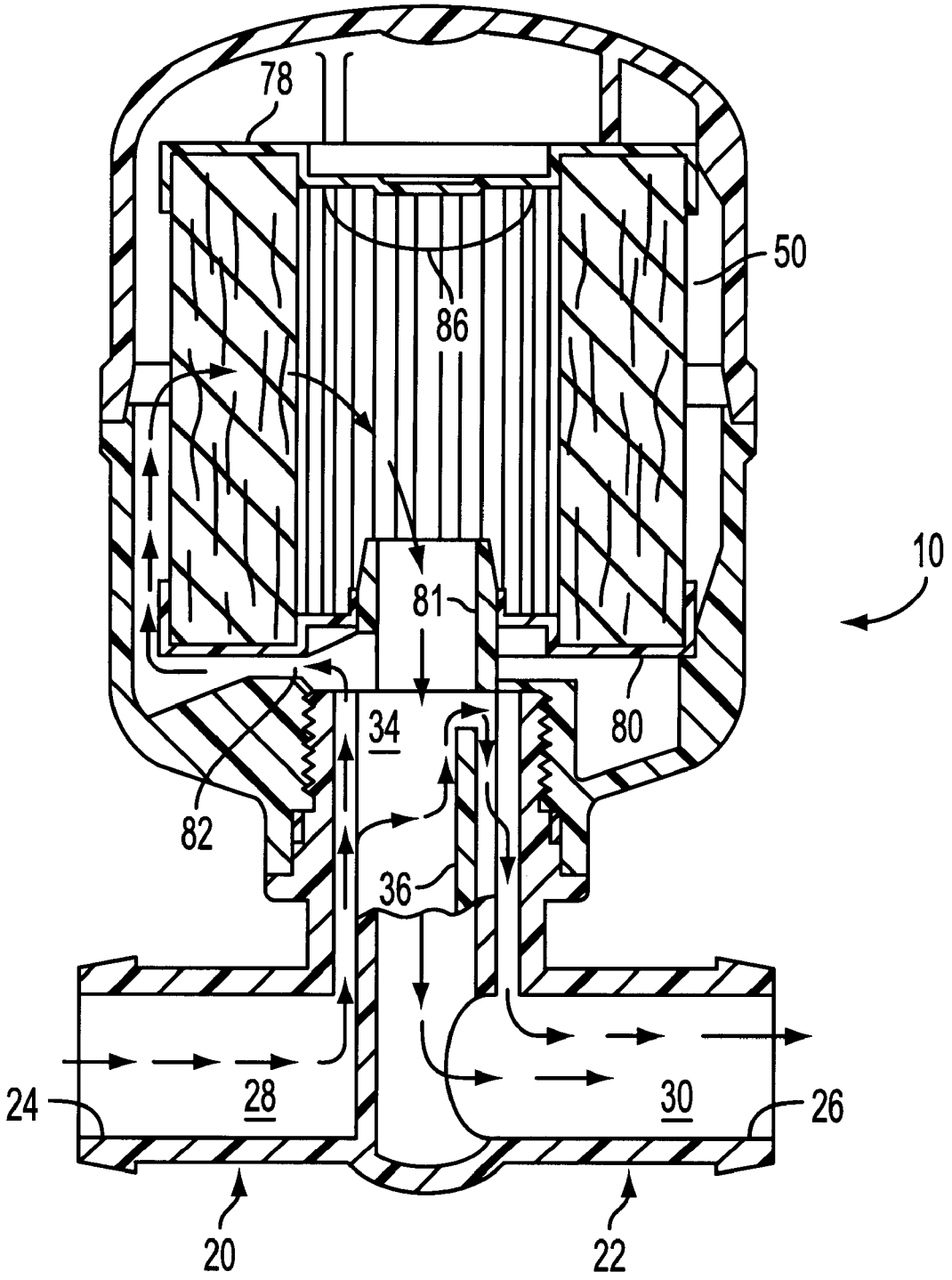
FIG. 4 is a cross-sectional view of the coolant filter assembly of FIGS. 1–3, with part of the housing outlet tube shown in cut away plan view, and showing the path of coolant flow therethrough.
Figure 5:
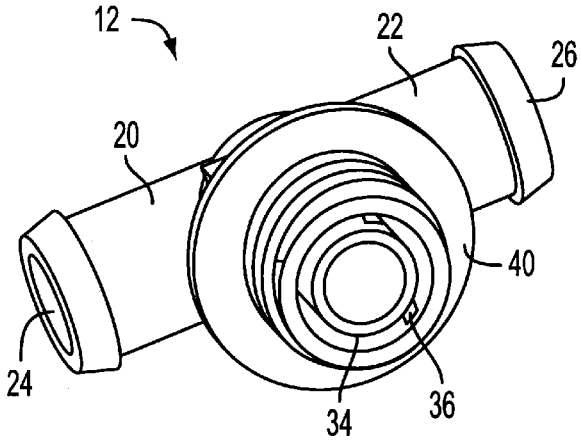
FIG. 5 is a perspective view of a fluid conduit member which is a component of the kit and assembly of FIGS. 1–4.
Figure 6:
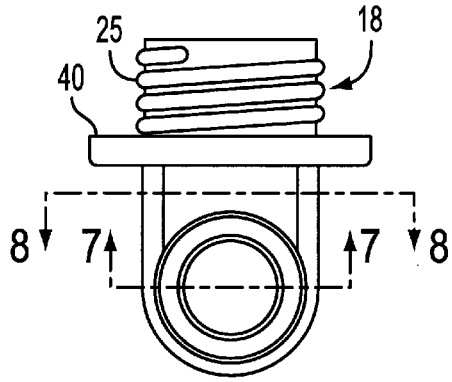
FIG. 6 is an end plan view of the fluid conduit member of FIG. 5.

As noted, the first main component of the coolant filter kit 16 hereof is a fluid conduit member 12. As seen in FIGS. 3–5, the fluid conduit member 12 includes a stem portion 18 and two opposed branches 20, 22 connected to an end of the stem and extending outwardly therefrom in substantially opposite directions. In the depicted embodiment, the fluid conduit member 12 is substantially T-shaped, although it could just as easily be Y-shaped.

Fluid conduit members 12, in accordance with the present invention, may be made in different sizes to accommodate different sized coolant flow lines. Illustrative examples of some coolant lines in which the fluid conduit member 12 may be installed include heater hose lines, primary flow lines connecting a vehicle radiator to an engine block, and the line connecting a vehicle radiator to a coolant overflow reservoir.

Figure 7:
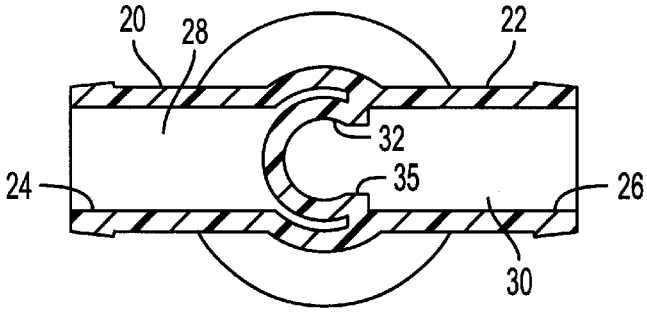
FIG. 7 is a cross section of the fluid conduit member hereof, taken along the line 7—7 of FIG. 6.

The fluid conduit member 12 has a conduit inlet 24 formed in a first branch 20 thereof, and a conduit outlet 26 formed in a second branch 22. The fluid conduit member 12 further has a first flow passage 28 formed therein in communication with the conduit inlet 24, a second flow passage 30 formed therein in communication with the conduit outlet 26, and a partition 32 (FIG. 7) in the stem 18 thereof The partition 32 substantially separates the first flow passage 28 from the second flow passage 30, and forces coolant flowing through the first flow passage to be routed around the partition, rather than linearly through the first and second branches 20, 22 of the conduit 12. When the completed assembly 10 is connected in-line in a coolant line, the partition 32 forces coolant into, and through, the filter apparatus 14 as will be further described herein.

Referring now to FIGS. 3–8, the stem 18 of the fluid conduit member 12 contains an internal coaxial sleeve 34, and the sleeve 34 has an opening 35 (FIGS. 8,9) formed in the base portion thereof to allow fluid communication between the interior of the sleeve and the second flow passage 30 leading to the conduit outlet 26. Therefore, the sleeve 34 forms a primary part of the partition 32, and defines separate and distinct flow passages on the inside and the outside thereof The cylindrical space outside the sleeve 34 in the stem 18 will be referred to herein as the intermediate zone 31, and the hollow space inside the sleeve will be referred to herein as the central pathway 33.

In the most preferred embodiment, a retaining wall 36 (FIGS. 4, 5, 8) is provided in the stem 18, blocking part of the intermediate zone 31 between the inside of the stem and the outside of the sleeve 34. As seen best in FIGS. 4 and 9, the retaining wall 36 does not come all of the way to the top of the stem 18, but rather stops short so as to leave a gap 38 thereabove in the interior of the stem, so as to provide a bypass or spillover pathway, as will be further described hereinbelow. (While the fluid conduit member shown in FIG. 9 is slightly modified from that shown in FIG. 4, the modification only relates to the location of the O-ring 44, and not to the internal structure of the conduit member).

The retaining wall 36 together with the sleeve 34 forms the partition 32. It is worth noting that the intermediate zone 31 outside of the sleeve 34 in the stem 18 is subdivided by the retaining wall 36, into an inlet side and an outlet side thereof.

The stem 18 has threads 25 (FIG. 6) formed on the exterior surface thereof for engaging in a threaded bore 58 of the coolant filter apparatus 14. The stem 18 is preferred to include an integrally formed transverse annular flange 40 extending outwardly thereon, below the threads 25 and proximate the connection of the first and second branches 20, 22 thereto. The flange 40 is provided to act as a stop member, limiting the extent to which the filter apparatus may be threadably and rotatably inserted on to the stem 18 of the fluid conduit member 12.

Figure 9:
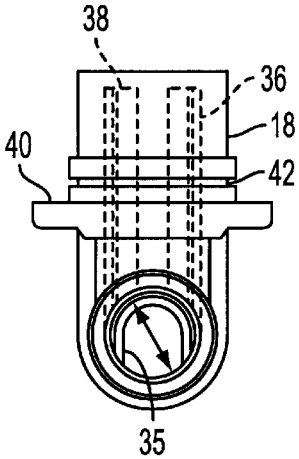
FIG. 9 is an end plan view of a modified version of the fluid conduit member hereof, showing a retaining wall in phantom.
Figure 8:
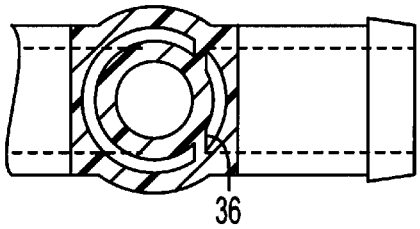
FIG. 8 is a cross-sectional view of the fluid conduit member hereof, taken along the line 8—8 of FIG. 6.

Most preferably, as shown in the modified embodiment of FIG. 9, the stem 18 includes an annular groove 42 formed therearound above the flange 40, to receive an O-ring seal 44 thereon.

As noted above, in the most preferred embodiment of the invention, the retaining wall 36 stops short of the outer surface of the stem 18 so that the partition 32 has a gap 38 thereabove (FIGS. 4, 9), to allow a limited amount of fluid flow therepast. The presence of the gap 38 adjacent the partition 32 provides a direct connection, of limited dimensions, between the first and second flow chambers 28, 30 of the fluid conduit member.

As best seen in FIG. 3, in this embodiment, the fluid conduit member 12 has an opening 39 formed therethrough, which communicates with the intermediate zone 31, at the base of the sleeve 32, on the outlet side of the retaining wall 36. This opening 39 is located near the second flow passage 30, and beyond the retaining wall 36, to allow fluid crossing the retaining wall and passing through the gap 38 to enter the second branch 22 of the conduit member 12.

This arrangement provides two distinct but interconnected fluid flow pathways through the conduit member 12, when the filter apparatus 14 is connected thereto to form the assembly 10. Both of these fluid flow pathways are shown by illustrative directional arrows in FIG. 4.

A first of such flow pathways routes the majority of fluid flow from the first flow channel 28 through the filter apparatus 14, under normal conditions, back into the conduit member, and out of the second branch 22 via the second flow channel 30 leading to the conduit outlet 26.

The second of the fluid flow pathways allows a limited amount of fluid to flow directly from the inlet through the first flow channel 28, into the inlet side of the intermediate zone, and over the retaining wall 36 through the gap 38. From the gap 38, the second flow pathway continues down the outlet portion of the intermediate zone 31, through the opening 39 at the base of the intermediate zone, into the second flow channel 30, and to the conduit outlet 26, without passing through the filter apparatus 14. This second fluid flow pathway is provided as a safety valve to allow some fluid flow through the system under all conditions, even under a condition where a filter member 50 becomes plugged with dirt, scale, or other contaminants.

THE FILTER APPARATUS

The coolant filter apparatus 14 is provided for attaching to the fluid conduit member 12 to form the assembly 10, and for cooperating therewith to filter engine coolant. The filter apparatus 14 includes a substantially cylindrical hollow housing 46 defining a filter chamber 48 therein for housing a cylindrical filter member 50. The housing 46 is preferably formed from an injection molded plastic material, and includes two primary components, which are a first half-shell or body section 52, and an end cap 54 which forms a second half-shell. Preferably, the body 52 and end cap 54 are spin-welded together to form a sealed unitary shell after the filter member 50 has been placed therein.

THE HOUSING BODY SECTION

The body section 52 (FIGS. 10–13) of the housing 46 is a first substantially cup-shaped member, and has an end wall 56 with a cylindrical bore 58 formed therein. The cylindrical bore 58 is internally threaded to threadably and rotatably receive the stem 18 of the fluid conduit member 12 therein. Preferably, the body section 52 has an integrally cast coaxial reinforcement ring 57 extending inwardly and/or outwardly from the end wall 56 to provide added depth to the cylindrical bore 58, and to strengthen and reinforce the connection between the fluid conduit member 12 and the filter apparatus 14.

A hollow cylindrical outlet tube 60 is provided as an integral part of the housing body section 52, and the outlet tube defines a central outlet bore 62 therethrough. As seen best in FIGS. 12 and 13, the outlet tube 60 is coaxially disposed in the filter chamber 48 adjacent the cylindrical bore 58. The outlet tube 60 is attached to the end wall 56 of the housing with a plurality of integrally cast spacers 64. Preferably, each of the spacers 64 includes a reinforcing rib 65 attached thereto and extending transversely inwardly thereon into the filter chamber 48. The body section of the housing 46 further has a series of inlet holes 66 formed therein at the innermost end of the cylindrical bore 58. The inlet holes 66 are arranged in an annular pattern surrounding the outlet tube 60, with the solid spacers 64 interspersed therebetween.

Figure 10:
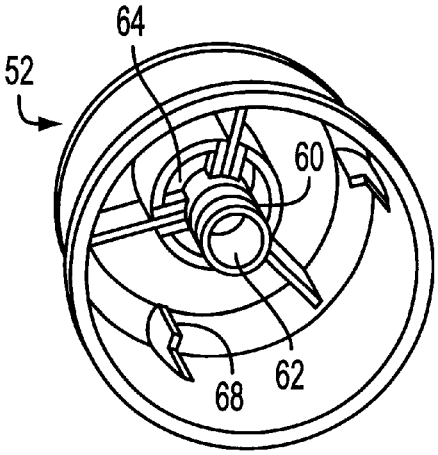
FIG. 10 is a perspective view of a housing body section which is another component of the assembly of FIGS. 1–4, showing the interior thereof.
Figure 11:
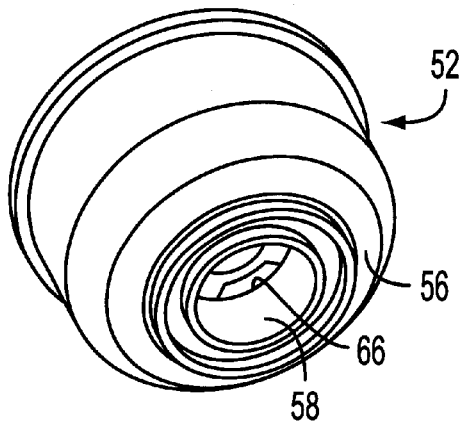
FIG. 11 is another perspective view of the housing body section of FIG. 10, showing the exterior thereof.
Figure 12:
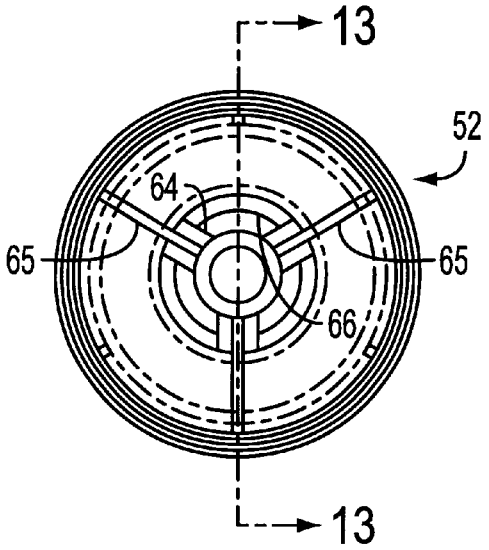
FIG. 12 is an internal end plan view of the housing body section of FIGS. 10–11.
Figure 13:
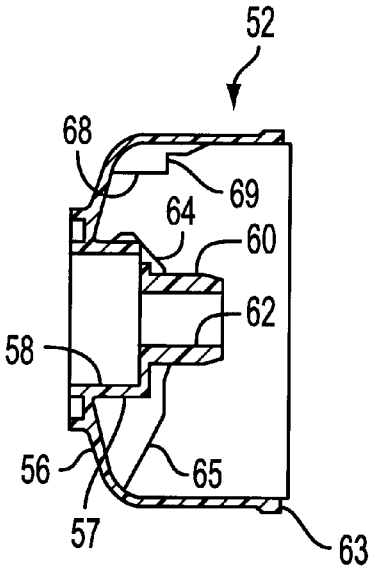
FIG. 13 is a cross-sectional view of the housing body section of FIGS. 10–12, taken along the line 13—13 of FIG. 12.

The body section 52 of the housing 46 also is preferred to include a plurality of integrally formed, radially spaced support bosses 68 arranged therearound, as shown in FIGS. 10 and 13, to help support the filter member 50 in the filter chamber 48 of the housing 46.

THE HOUSING END CAP

Figure 14:
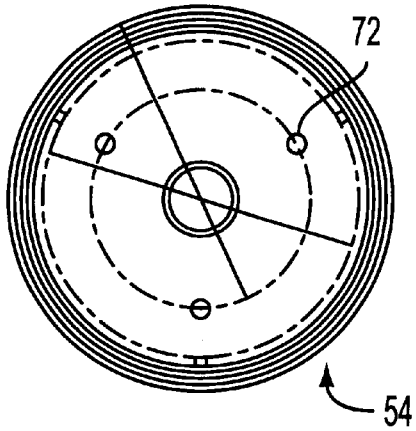
FIG. 14 is an end plan view of a housing end cap which is another component of the assembly of FIGS. 1–4.
Figure 15:
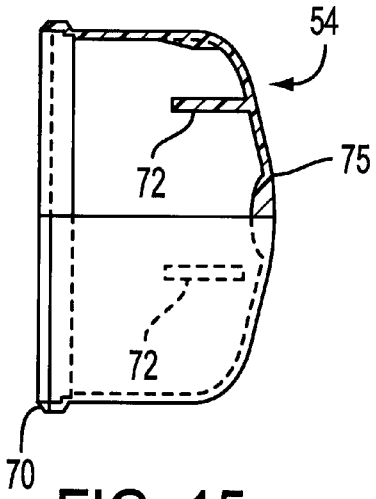
FIG. 15 is a side plan view of the housing end cap of FIG. 12, partially in crosssection.

As best seen in FIGS. 14 and 15, the housing end cap 54 is a second generally cupshaped member having a peripheral lip 70 dimensioned to engage a corresponding lip 63 of the body section 52, and to be sealingly affixed thereto. The end cap 54 does not have any holes or apertures formed therethrough, but preferably does include a plurality of stabilizer posts 72 extending inwardly into the filter chamber 48 from an end wall 75 (FIG. 15) thereof, to contact and reinforcingly support the filter member 50 in the housing 46.

THE FILTER MEMBER

As noted, a filter member 50 (FIGS. 3 and 4) is disposed in the filter chamber 48 of the housing. The filter member 50 includes a porous cylindrical filter element 74 having a hollow bore (not shown) formed centrally therein. The filter member 50 is arranged in the housing filter chamber 48 such that the hollow bore of the filter element 74 surrounds, and is in communication with the housing outlet tube 60. In a preferred embodiment of the invention, the filter member 50 further includes a first, substantially disc-shaped end plate 78, which is attached to the filter element 74 at a first end thereof opposite the housing outlet tube 60. In this preferred embodiment, the filter member also includes a second, substantially washer-shaped end plate 80, attached to a second end of the filter element 74 adjacent the housing outlet tube 60, and having a central aperture 81 formed therein which closely receives the innermost end of the housing outlet tube 60 therein. In this preferred embodiment, the filter member 50 is oriented in the housing 46 such that the central aperture 81 of the second end plate 80 surrounds, and is in fluid communication with, the housing outlet tube 60. The end plates 78, 80 are preferably formed from lightweight metal or plastic.

Also in the preferred embodiment of the invention, the filter apparatus 14 includes at least one spacer means for spacing the filter member 50 away from the housing inlet holes 64, in the cylindrical bore 58 of the housing body section. In the depicted embodiment, this spacer means is provided in part by the reinforcing ribs 65. Each of the reinforcing ribs 65 has a flat ridge 67 thereon (see FIG. 3) to abuttingly contact the filter member at its second end plate 80, and to space it away from the inlet holes 66 at the inner end of the reinforcing ring 57. In addition, in the depicted embodiment, each of the support bosses 68, along the outer wall of the body section 52, is preferred to include a shelf 69 (FIG. 13) for supportively receiving a corner of the filter member 50 and for helping to space it away from the housing inlet holes 64 at the inner edge of the reinforcing ring 57.

Spacing the filter member away from the housing inlet holes of the reinforcing ring 57, in this way, provides a channel 82 for coolant, passing into the filter chamber 48 through the housing inlet holes 66, to follow around to the outside of the filter member 50. From outside the filter member 50, the coolant flows through the wall of the filter element 74, following the arrows in FIG. 4. The filter element 74 allows liquid coolant to pass therethrough, while retaining dirt and solid particles on the surface thereof After passing into the internal bore of the filter member, coolant then flows out of the filter apparatus 14 through the housing outlet tube 60, and back into the fluid conduit member 12 via the hollow bore 62 formed in the inner sleeve 34 thereof From the inner sleeve 34, the coolant passes through the opening 35 of the sleeve, into the second fluid passage 30, and out of the conduit outlet 26, passing into coolant line such as, for example, a heater hose (not shown).

Optionally, the filter apparatus may include a slow dissolving supplemental coolant additive (SCA) plug 86, for releasing a supplemental coolant additive into coolant over time. Where used, the SCA plug 86 may be centrally attached to the inner surface of the filter member disc-shaped first end plate 78, as shown in FIG. 4, or placed in another location in the filter chamber 48 where it will be contacted, and slowly dissolved by, coolant flow therepast.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

What is claimed is:

1. A coolant filter kit for attaching to an engine coolant hose, comprising:

(a) a fluid conduit member having a stem, said stem including means for attaching a coolant filter apparatus, and two opposed branches connected to said stem, (1) said fluid conduit member having an inlet formed in a first of said branches and an outlet formed in a second of said branches;

(2) said stem of said fluid conduit member further having a cylindrical sleeve coaxially disposed within said stem, said sleeve defining an intermediate zone therearound within said stem, said sleeve further defining an internal zone therewithin that functions as an outlet flow passage in communication with said outlet, and a wall disposed in said intermediate zone and being integrally formed with said sleeve and said stem, said wall dividing said intermediate zone into a first portion that that functions as an inlet flow passage within the stem in communication with said inlet and a second portion that functions as a bypass flow passage in communication with said outlet, said wall providing for fluid communication through or around the wall from said first portion to said second portion such that fluid bypass around said coolant filter apparatus is provided; and (b) a coolant filter apparatus for attaching to said stem of said fluid conduit member, said filter apparatus comprising:

(1) a hollow housing defining a filter chamber therein, said housing having means for interconnecting said coolant filter apparatus to said stem of said fluid conduit member;

(2) a hollow outlet tube disposed in said filter chamber, adapted for communication with said outlet flow passage and connected to an end wall of said housing, said housing further having a plurality of inlet holes, adapted for communication with said inlet flow passage, formed therein outside of said outlet tube; and (3) a filter member disposed in said housing and comprising a porous filter element having a hollow bore formed centrally therein, said filter apparatus being constructed and arranged so that said hollow bore of said filter element is in communication with said housing outlet tube.

2. The coolant filter kit of claim 1, wherein said filter element is substantially cylindrical in shape, and further wherein said filter member comprises a first substantially disc-shaped end plate attached to said filter element at a first end thereof, and a second end plate attached to a second end of said filter element and having a central aperture formed therein, said filter element oriented in said housing such that said central aperture of said second end plate surrounds and is in fluid communication with said housing outlet tube.

3. The coolant filter kit of claim 2, further comprising spacer means for spacing said filter member away from said housing inlet holes.

4. The coolant filter kit of claim 3, wherein said spacer means comprises a plurality of ribs extending radially inwardly from an inner surface of said housing into said filter chamber, each of said ribs comprising a flat ridge thereon for abuttingly contacting a portion of said filter member.

5. The coolant filter kit of claim 4, wherein said spacer means further comprises a plurality of support bosses attached to an inner surface of said housing, each of said support bosses comprising a shelf for supportively receiving a portion of said filter member thereon.

6. A filter assembly for attaching to an engine coolant hose, comprising:

(a) a fluid conduit member having a stem, said stem including means for attaching a coolant filter apparatus, and two opposed branches connected to said stem, (1) said fluid conduit member having an inlet formed in a first of said branches and an outlet formed in a second of said branches;

(2) said stem of said fluid conduit member further having a cylindrical sleeve coaxially disposed within said stem, said sleeve defining an intermediate zone therearound within said stem, said sleeve further defining an internal zone therewithin that functions as an outlet flow passage in communication with said outlet, and a wall disposed in said intermediate zone and being integrally formed with said sleeve and said stem, said wall dividing said intermediate zone into a first portion that that functions as an inlet flow passage within the stem in communication with said inlet and a second portion that functions as a bypass flow passage in communication with said outlet, said wall providing for fluid communication through or around the wall from said first portion to said second portion such that fluid bypass around said coolant filter apparatus is provided; and (b) a coolant filter apparatus attached to said stem of said fluid conduit member, said filter apparatus comprising:

(1) a hollow housing defining a filter chamber therein, said housing having means for interconnecting said coolant filter apparatus to said stem of said fluid conduit member;

(2) a hollow outlet tube disposed in said filter chamber, in communication with said outlet flow passage and connected to an end wall of said housing, said housing further having a plurality of inlet holes, in communication with said inlet flow passage, formed therein outside of said outlet tube; and (3) a filter member disposed in said housing and comprising a porous filter element having a hollow bore formed centrally therein, said filter apparatus being constructed and arranged so that said hollow bore of said filter element is in communication with said housing outlet tube.

7. A fluid conduit member for cooperating with a filter apparatus to route fluid flow to and from said filter apparatus, said fluid conduit member having a stem, said stem including means for attaching said filter apparatus, and two opposed branches connected to said stem, said fluid conduit member having an inlet formed in a first of said branches and an outlet formed in a second of said branches;

said stem of said fluid conduit member further having a cylindrical sleeve coaxially disposed within said stem, said sleeve defining an intermediate zone therearound within said stem, said sleeve further defining an internal zone therewithin that functions as an outlet flow passage in communication with said outlet, and a wall disposed in said intermediate zone and being integrally formed with said sleeve and said stem, said wall dividing said intermediate zone into a first portion that that functions as an inlet flow passage within the stem in communication with said inlet and a second portion that functions as a bypass flow passage in communication with said outlet, said wall providing for fluid communication through or around the wall from said first portion to said second portion such that fluid bypass around said coolant filter apparatus is provided.

* * * * *